US006465066B1

(12) United States Patent
Rule et al.

(10) Patent No.: US 6,465,066 B1
(45) Date of Patent: Oct. 15, 2002

(54) PACKAGED POTABLE LIQUID AND PACKAGING FOR POTABLE LIQUID

(75) Inventors: Mark Rule; James Ellison Shepherd, both of Atlanta, GA (US); Colin Beveridge, Rutland (GB); Homaira Naseem, Boylston, MA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 09/309,813

(22) Filed: May 11, 1999

(51) Int. Cl.[7] ..... B65B 3/00

(52) U.S. Cl. ..... 428/35.7; 222/148; 222/567; 524/261; 524/275; 524/277; 524/269; 524/394

(58) Field of Search ..... 428/35.7; 222/148, 222/567, 275, 277; 524/261, 269, 394

(56) References Cited

U.S. PATENT DOCUMENTS

| | | | | | |
|---|---|---|---|---|---|
| 4,198,369 | A | * | 4/1980 | Yoshikawa et al. | 264/268 |
| 4,731,190 | A | | 3/1988 | O'Lenick, Jr. et al. | 252/49.3 |
| 4,842,648 | A | * | 6/1989 | Phadoemchit et al. | 106/244 |
| 5,285,933 | A | * | 2/1994 | Gentes et al. | 222/148 |
| 5,419,446 | A | * | 5/1995 | Cox et al. | 215/21 |
| 5,486,558 | A | * | 1/1996 | Lee | 524/241 |
| 5,663,223 | A | * | 9/1997 | Teumac et al. | 524/109 |
| 5,731,053 | A | * | 3/1998 | Kuhn et al. | 428/369.2 |
| 5,837,339 | A | | 11/1998 | Wood et al. | 428/36.6 |
| 5,863,964 | A | * | 1/1999 | Teumac et al. | 523/100 |
| 5,948,846 | A | | 9/1999 | Libert et al. | 524/451 |

FOREIGN PATENT DOCUMENTS

| | | |
|---|---|---|
| WO | WO 96/04833 | 2/1996 |
| WO | WO96/04833 | 2/1996 |

OTHER PUBLICATIONS

Alger, Polymer Science Dictionary 2$^{nd}$ edition, Chapman & Hall, 1997, p. 405.*

* cited by examiner

*Primary Examiner*—Harold Pyon
*Assistant Examiner*—Sow-Fun Hon
(74) *Attorney, Agent, or Firm*—Sutherland Asbill & Brennan LLP

(57) ABSTRACT

A packaged potable liquid, such as bottled water, wherein the liquid has little or no plastic off-taste. The packaged liquid includes a closure wherein the closure shell or the liner within the closure comprises a plastic matrix and an organic slip agent dispersed in the plastic matrix, the slip agent being substantially fully ethylenically saturated and the closure or the liner being substantially free of an ethylenically unsaturated compound. The packaged liquid also includes a container which is desirably substantially free of an ethylenically unsaturated compound.

28 Claims, 2 Drawing Sheets

PACKAGED POTABLE LIQUID AND PACKAGING FOR POTABLE LIQUID

TECHNICAL FIELD

This invention relates to packaged potable liquid such as bottled water, and, particularly, relates to a potable liquid packaging which does not impart an off-taste to the potable liquid.

BACKGROUND OF THE INVENTION

Water packaged in plastic containers is a large segment of the beverage market. Historically, water packaged in plastic containers develops an off-taste after a short period of storage. This off-taste is often described as a "plastic" off-taste and is most pronounced in water packaged in polyolefin containers, but is also noted in containers made of other plastics, such as PET, especially if the container is closed with a polyolefin closure.

It is known to those skilled in the art that the plastic off-taste can be correlated with the presence of long-chain aldehydes, particularly the aldehydes such as octanal, nonanal, decanal, and decenal. These aldehydes are detectable in water at the part per billion (ppb) level. Although the plastic off-taste is noticeable in all waters packaged in plastic containers, it is particularly noticeable if the water has been treated with ozone prior to packaging.

The origin of the plastic off-taste is commonly thought to arise from thermal degradation of the polyolefins during processing; consequently, antioxidants are frequently added to the polyolefins to inhibit these degradation reactions. This approach achieves some reduction in the amount of plastic off-taste developed during storage of water in these containers; however, a plastic off-taste is frequently still noticeable.

Prior art inventions to address this problem, such as PCT patent application WO 96/04833, involve the addition of agents that can complex with aldehydes. Unfortunately, because of the low concentration of these aldehydes and their significant solubility in water, this approach only removes a small portion of the aldehydes.

Consequently, there remains a need for plastic packaging that does not impart a plastic off-taste to water. It is therefore an object of the present invention to prevent formation of plastic off-taste in water packaged in plastic containers.

SUMMARY OF THE INVENTION

It has now been discovered that the formation of aldehydes during thermal processing of polyolefins, and particularly on exposure to ozonated water, is not due to the thermal degradation of the polyolefins themselves, but rather is due to the degradation of the ethylenically unsaturated slip agents and lubricants used. These lubricants are typically unsaturated fatty acid amides. As lubricants, the fatty acid amides are used to improve mold flow and mold release for polyolefins. Slip agents improve the torque removal properties of the closure. In other words, slip agents make it easier to remove a closure which has been tightly threaded onto a container.

A particularly popular lubricant is erucamide. Erucamide is also used almost universally as a slip agent in polyolefin closures. In this role, the erucamide functions to reduce the coefficient of friction between the closure liner (or closure shell) and the container finish. Without such a slip agent, removal torques for such closures would be unacceptably high. Erucamide is widely used as a slip agent and lubricant because of its low cost and useful properties. Erucamide is a C-22 fatty acid amide that possesses a double bond at the C-13 position. Ozone, in particular, is extremely effective at selectively cleaving this double bond, creating the C-9 aldehyde nonanal.

Therefore, the present invention is directed toward polyolefin compositions for closure shells, closure liners, and containers that avoid the formation of aldehydes such as nonanal. This invention encompasses polyolefin compositions that are substantially free of ethylenically unsaturated additives. This invention also encompasses the use of these polyolefin compositions for the packaging of water, especially ozonated water.

More particularly, this invention solves the above described problem in the prior art by providing potable liquid packaging which is substantially free of an ethylenically unsaturated compound, and packaged potable liquids including such packaging. The packaging of this invention can include a container having an opening and a removable closure for sealing the opening, wherein the container or the closure, or both, comprise a shell including a plastic matrix which is substantially free of an ethylenically unsaturated compound. Desirably, the container shell or closure shell, or both, comprise a substantially fully ethylenically saturated slip agent dispersed in the respective plastic matrix.

Alternatively, the removable closure can include a liner comprising a plastic matrix and an organic slip agent dispersed in the plastic matrix of the liner, wherein the slip agent is substantially fully ethylenically saturated and the liner is substantially free of an ethylenically unsaturated compound. Because any slip agent in the closure shell, container shell or liner is ethylenically saturated, ozone does not react with the slip agent and produce aldehydes which cause plastic off-taste. The slip agent allows for easy removal of the closure even when tightly threaded onto the associated container.

Desirably, the organic slip agent has an iodine value of less than 10, more desirably less than 5, more desirably less than 1, and still more desirably has an iodine value of 0. The iodine value is a number expressing the percentage, in grams per 100 grams, of iodine absorbed by a substance and is a measure of the proportion of unsaturated linkages present in an organic compound.

Furthermore, the closure shell, the container shell, and liner, are at least 99.98% free of an ethylenically unsaturated compound and more desirably is at least 99.99% free of ethylenically unsaturated compound. In other words, the container shell, the closure shell, or the liner can include trace amounts of unsaturated compound but not enough to produce sufficient quantities of aldehydes when exposed to ozone to create a plastic off-taste detectable by human taste. Most desirably, the container shell, the closure shell, and/or the liner is 100% free of ethylenically saturated compound.

The packaged potable liquid of this invention comprises a potable liquid, such as water, disposed within the container of the packaging described above. Water packaged according to this invention is desirably ozonated.

Accordingly, an object of this invention is to provide potable liquid such as water packaged in plastic containers, but having little or no plastic off-taste.

Other objects, features, and advantages will be apparent from the following detailed description of embodiments, drawings, and claims.

BRIEF DESCRIPTION OF DRAWINGS

FIG. 5 illustrates the closure in the closed position.

BRIEF DESCRIPTION OF EMBODIMENTS

As summarized above, this invention encompasses potable liquid packaging which imparts little or no plastic off-taste to the potable liquid, such as water. Also, this invention encompasses packaging for potable liquid and compositions for making such packaging. For example, this invention encompasses a container closure and liner for packaged potable liquid. The use of a substantially fully saturated slip agent in the closure or liner, or both, instead of an unsaturated slip agent eliminates the production of aldehydes produced in prior packaging and alleviates the off-taste which would otherwise be caused by such aldehydes. Below is a detailed description of packaged potable water, a closure, and a closure liner, all made in accordance with embodiments of the present invention, and a description of the chemical composition of the closure shell and liner.

Figure 1:
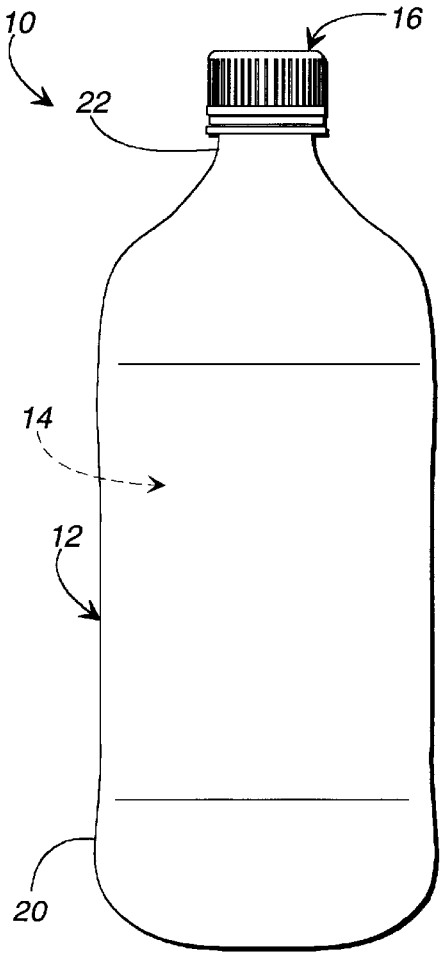
FIG. 1 is a perspective view of packaged potable water made in accordance with an embodiment of this invention.

FIG. 1 illustrates a package 10 of potable water comprising a container 12 containing ozonated water 14 and sealed by a closure 16. The container 12 includes a shell 20 which is a typical plastic water bottle including a threaded neck 22 leading to a mouth or opening. The container 12 is made by conventional methods and is desirably formed of polyethylene terephthalate (PET). The container 12 can also be made of other thermoplastic materials including polypropylene, polyethylene, polystyrene, and the like, and materials such as metal or glass, and is desirably substantially free of an ethylenically unsaturated compound.

The potable liquid 14 in the container is desirably ozonated water, but can also be any one of a variety of beverages such as soft drinks, coffee, tea, fruit and vegetable juice, isotonic beverages and nonisotonic beverages. With bottled water, ozone is added to kill microorganisms in the water. This is accomplished by conventional means.

Figure 2:
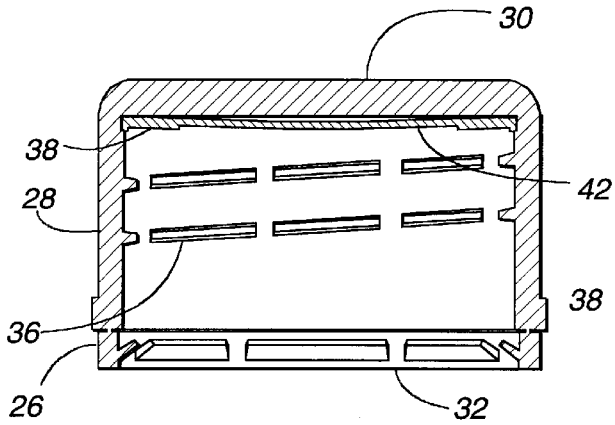
FIG. 2 is a sectional elevation view of a closure for the packaged liquid illustrated in FIG. 1.
Figure 3:
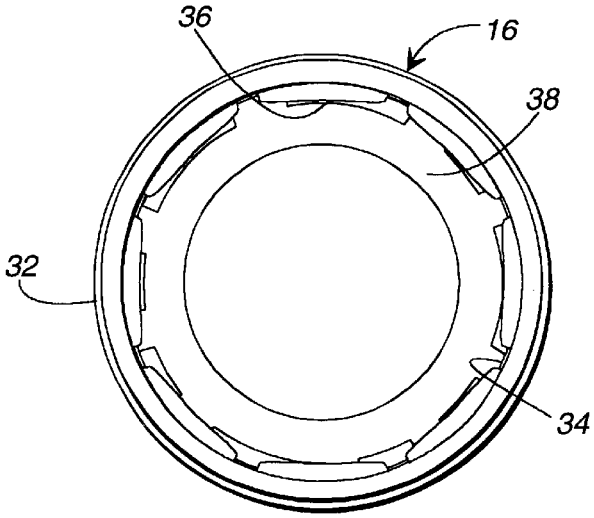
FIG. 3 is a plan view of the closure illustrated in FIG. 2.
Figure 4:
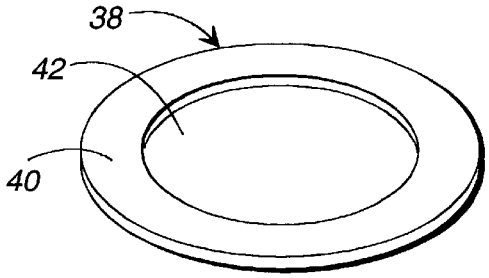
FIG. 4 is a perspective view of the closure liner in the closure illustrated in FIG. 2.

FIGS. 2 and 3 further illustrate the closure 16. As can be seen, the closure 16 includes a shell 26 comprising a cylindrical side wall 28 extending between a top cover 30 and an opening 32 for receiving the threaded neck 22 of the container 12. The interior 34 of the closure shell 26 includes threads 36 which mate with threads on the exterior of the container neck 22.

The closure 16 can be made of materials such as metal or glass, but is desirably made of a thermoplastic material. Suitable thermoplastic materials for the cap include polypropylene, polyethylene such as linear low density polyethylene, PET, polystyrene, and the like. The closure 16 is made by conventional means understood by those skilled in the art.

The closure 16 also includes a thermoplastic liner 38 disposed in the interior 34 of the closure shell 26 against the top cover 30 of the closure. The liner creates a fluid-tight seal between the mouth of the container 12 and the closure 16 when the closure is threaded tightly onto the neck 22 of the container. The liner 38 includes a raised outer ring 40 which directly contacts the mouth of the container 12 and a recessed central portion 42 inside the outer ring.

The thermoplastic liner 38 is made and deposited inside the closure 16 by conventional means. For example, the liner 38 can be compression molded and then inserted into the closure shell 26 or the liner can be formed in situ by depositing heated thermoplastic liner material in the closure shell 26 and pressing the thermoplastic material against the top cover 30 of the closure.

Suitable thermoplastics to form the polymer matrix of the liner include ethylene vinyl acetate (EVA), polyvinyl chloride (PVC), PET, polyethylene, polypropylene, polyurethane, copolymers of vinyl chloride and vinyl acetate, ethylcellulose, cellulose acetate, cellulose acetate butyrate, terpolymers, alkylacrylates, copolymers and terpolymers of styrene, polyamides, polyesters, and other polyolefins.

The thermoplastic material of the liner 38 also includes conventional additives known to those skilled in the art and, in accordance to this invention, includes a substantially fully ethylenically saturated slip agent. The thermoplastic composition for the liner is substantially free of an ethylenically unsaturated slip agent or any ethylenically unsaturated compound. The slip agent or slip agents and other compounds in the liner 38 should be sufficiently saturated so that any oxygen, such as ozone, in the container 12 does not react with the slip agent or slip agents or other compounds and produce a level of aldehydes, such as nonanal, sufficient to be detected by human taste. The organic slip agent or slip agents in the liner 38 desirably have an iodine value of less than 10, more desirably have an iodine value less than 5, more desirably have an iodine value less than 1, and still more desirably have an iodine value of 0. The iodine value is a number expressing the percentage, in grams per 100 grams, of iodine absorbed by a substance and is a measure of the proportion of unsaturated linkages present in an organic compound. The iodine value is determined according to ASTM D 1959, the Wijs method.

It is desirable that the container shell 12, the closure shell 26 and the liner 38 be substantially free of an ethylenically unsaturated compound. By ethylenically saturated, it is meant that the compound does not possess carbon carbon double or triple bonds. Instead, the bonded carbons are also bonded to elements such as hydrogen, fluorine, or silicone. Desirably, the container shell 12, the closure shell 26 and the liner 38 are at least 99.98%, by weight, free of ethylenically unsaturated compound. More desirably, the container shell 12, the closure shell 26 and the liner 38 are at least 99.99%, by weight, free of ethylenically unsaturated compound. Preferably, the container shell 12, the closure shell 26 and the liner 38 are 100%, by weight, free of ethylenically unsaturated compound.

Suitable ethylenically saturated slip agents for the liner 38 include behenamide, polysiloxane, fluoropolymers, paraffin wax, carbowax, synthetic mineral oil, and mixtures thereof. Generally, suitable slip agents of the present invention include any ethylenically saturated organic compound that meets the requirements of a slip agent. A slip agent is a material that is incorporated into the polymer matrix of the liner and lubricates the outer surface of the liner so that the closure 16 can be easily removed from the neck 22 of the container 12, even when tightly threaded onto the neck of the container. Desirably, the slip agent is present in the liner in an amount from about 0.2 to about 2% by weight of the liner. For example, the liner 38 can comprise 99 parts EVA, 2 parts behenemide, and 0.1 parts of a blue colorant.

Although the closure 16 illustrated in FIGS. 1–3 includes a liner 38, sealable closures can be made without liners. In such a case, the polymer matrix of the closure shell includes a slip agent. The same saturated slip agents described above are suitable in a linerless closure and are desirably present in the polymer matrix of the closure in the same amounts as in the liner. Although not desirable, the container shell 12 could include the slip agent.

Figure 5:
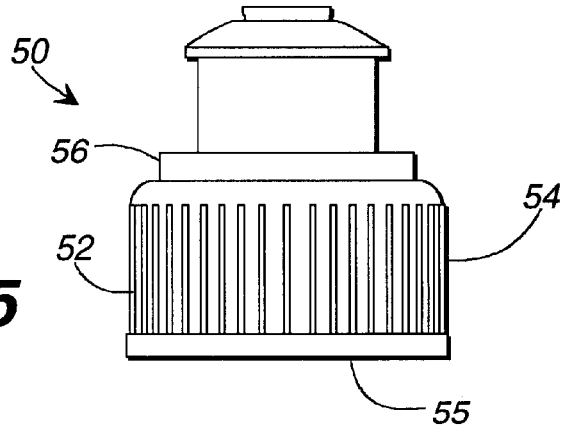
FIG. 5 is an elevation view of a dispensing closure for packaged potable liquid made in accordance with an embodiment of this invention.
Figure 6:
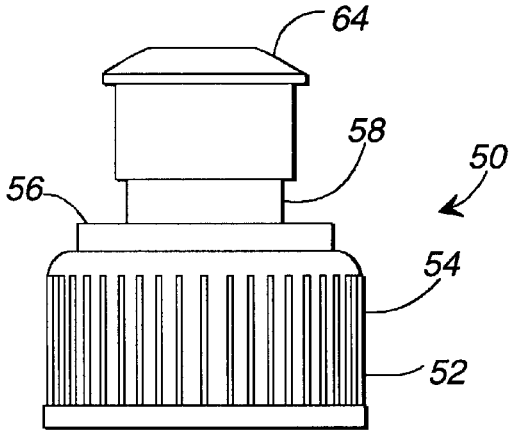
FIG. 6 illustrates a dispensing closure of FIG. 5 in the open position.
Figure 7:
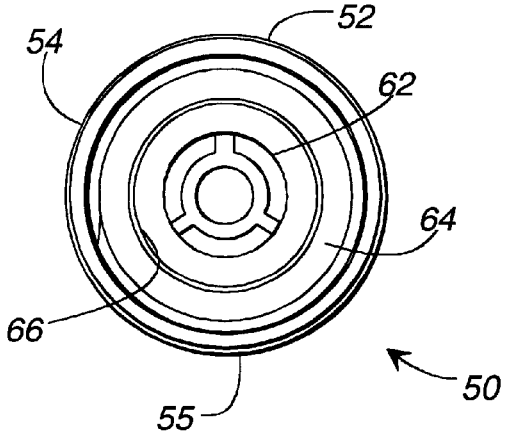
FIG. 7 is a plan view of the dispensing closure illustrated in FIG. 5.

FIGS. 5–7 illustrate a dispensing closure 50 which does not include a liner. Dispensing closures are often used as closures for bottled water and sports drinks because the dispensing closure makes it easier to drink directly from the bottle and close the bottle. The physical structure of the dispensing closure 50 is conventional and includes a shell 52 including a cylindrical side wall 54 extending from an opening 55 for receiving the threaded neck of a container to a shoulder 56. A spout 58 extends outwardly from the shoulder 56 of the shell 52 to an opening 62 for dispensing liquid inside the associated container. A reciprocable cap 64 fits over the spout 58 and can be shifted up and down to open and close the spout. FIG. 5 illustrates the dispensing closure 50 in the closed position and FIG. 6 illustrates the dispensing closure in the open position.

The shell 52 of the dispensing closure 50 includes thread 64 in the interior of the shell for receiving the threads of the associated bottle neck and an annular sealing abutment 66 which contacts the mouth of the container and forms a seal.

The dispensing closure 50 can be made of the same polymers as the closure 16 illustrated in FIGS. 2 and 3 and includes the same saturated slip agents in the same amounts.

The following Examples 1–10 in Table 1 illustrate the performance of embodiments of this invention as compared to conventional bottled water packaging. Examples 1 and 2 are comparative examples and Examples 3–10 illustrate embodiments of this invention. As can be seen, the replacement of erucamide with behenamide as a slip agent in the liner or closure shell substantially reduced the presence of nonanal in water held in the container for 8 weeks. Examples 1–6 and 10 illustrate containers with a lined closure and Examples 7–9 illustrate containers with a linerless closure.

| | | | | | | |
|---|---|---|---|---|---|---|
| 6 | glass | EVA | 2.5% behenamide | polypropylene | 0.4% erucamide | 1.2 |
| 7 | glass | no liner | no liner | polypropylene | 0.1% erucamide | 0.2 |
| 8 | PET | no liner | no liner | polyethylene | 0.4% behenamide | Not detected |
| 9 | glass | no liner | no liner | polypropylene | 0.8% behenamide | Not detected |
| 10 | glass | no liner | 2.5% behenamide | polypropylene | 0.8% behenamide | Not detected |

* This is the amount of nonanal (micrograms/liter) present in the bottled water after 8 weeks in the container.

It should be understood that the foregoing relates to preferred embodiments of this invention and that numerous changes may be made therein without departing from the scope of the invention as defined by the following claims.

We claim:

1. A packaged potable liquid comprising:

a container having an opening;

a potable ozonated liquid within the container; and a removable closure sealing the opening, the closure comprising a shell, wherein the closure shell comprises:

a plastic matrix; and an organic slip agent dispersed in the plastic matrix, wherein the slip agent is fully ethylenically saturated with an iodine value less than 5, and wherein the closure shell is at least about 99.98% free of ethylenically unsaturated compound.

2. A packaged potable liquid as in claim 1 wherein the potable ozonated liquid is ozonated water.

3. A packaged potable liquid as in claim 1 wherein the ethylenically saturated slip agent is selected from the group consisting of behenamide, polysiloxanes, fluoropolymers, paraffin wax, carbowax, synthetic mineral oil, and mixtures thereof.

4. A packaged potable liquid as in claim 1 wherein the closure is a dispensing closure comprising a spout.

5. A packaged potable liquid comprising:

a container having an opening;

a potable ozonated liquid within the container; and a removable closure sealing the opening, the closure comprising a shell and a liner, wherein the liner comprises:

a plastic matrix; and an organic slip agent dispersed in the plastic matrix, wherein the slip agent is fully ethylenically saturated with an iodine value less than 5, and wherein the liner is at least about 99.98% free of ethylenically unsaturated compound.

6. A packaged potable liquid as in claim 5 wherein the potable ozonated liquid is ozonated water.

7. A packaged potable liquid as in claim 5 wherein the ethylenically saturated slip agent is selected from the group consisting of behenamide, polysiloxanes, fluoropolymers, paraffin wax, carbowax, synthetic mineral oil, and mixtures thereof.

8. A packaged potable liquid as in claim 5 wherein the closure is a dispensing closure comprising a spout.

9. A packaged potable liquid comprising a container having an opening, a potable ozonated liquid within the container, and a removable closure sealing the opening, the container comprising a shell, wherein the container shell comprises a plastic matrix and an organic slip agent dispersed in the plastic matrix, wherein the slip agent is fully ethylenically saturated with an iodine value less than 5, and wherein the shell is at least about 99.98% free of ethylenically unsaturated compound.

10. A packaged potable liquid as in claim 9 wherein the closure comprises a shell comprising a plastic matrix which is free of an ethylenically unsaturated compound.

11. A packaged potable liquid as in claim 9 wherein the closure comprises a liner comprising a plastic matrix which is free of an ethylenically unsaturated compound.

12. A packaged potable liquid as in claim 9 wherein the potable ozonated liquid is ozonated water.

13. A packaged potable liquid as in claim 11 wherein the liner further comprises an ethylenically saturated organic slip agent having an iodine value less than 10.

14. A packaged potable liquid as in claim 1 wherein the ethylenically saturated organic slip agent has an iodine value less than 1.

15. A packaged potable liquid as in claim 1 the ethylenically saturated organic slip agent has an iodine value of 0.

16. A packaged potable liquid as in claim 1 wherein the closure shell is at least 99.99% free of ethylenically unsaturated compound.

17. A packaged potable liquid as in claim 1 wherein the closure shell is 100% free of ethylenically unsaturated compound.

18. A packaged potable liquid as in claim 1 wherein the plastic matrix comprises a thermoplastic polymer.

19. A packaged potable liquid as in claim 5 wherein the ethylenically saturated organic slip agent has an iodine value less than 1.

20. A packaged potable liquid as in claim 5 the ethylenically saturated organic slip agent has an iodine value of 0.

21. A packaged potable liquid as in claim 5 wherein the liner is at least 99.99% free of ethylenically unsaturated compound.

22. A packaged potable liquid as in claim 5 wherein the liner is 100% free of ethylenically unsaturated compound.

23. A packaged potable liquid as in claim 5 wherein the plastic matrix comprises a thermoplastic polymer.

24. A packaged potable liquid as in claim 9 wherein the ethylenically saturated organic slip agent has an iodine value less than 1.

25. A packaged potable liquid as in claim 9 the ethylenically saturated organic slip agent has an iodine value of 0.

26. A packaged potable liquid as in claim 9 wherein the container shell is at least 99.99% free of ethylenically unsaturated compound.

27. A packaged potable liquid as in claim 9 wherein the container shell is 100% free of ethylenically unsaturated compound.

28. A packaged potable liquid as in claim 9 wherein the plastic matrix of the container shell comprises a thermoplastic polymer.

* * * * *